US009410766B1

(12) United States Patent
Falla

(10) Patent No.: US 9,410,766 B1
(45) Date of Patent: Aug. 9, 2016

(54) SLING

(71) Applicant: Jason M. Falla, Chesapeake, VA (US)

(72) Inventor: Jason M. Falla, Chesapeake, VA (US)

( * ) Notice: Subject to any disclaimer, the term of this patent is extended or adjusted under 35 U.S.C. 154(b) by 0 days.

(21) Appl. No.: 14/639,966

(22) Filed: Mar. 5, 2015

Related U.S. Application Data

(60) Provisional application No. 61/948,435, filed on Mar. 5, 2014.

(51) Int. Cl.
*F41C 33/00* (2006.01)

(52) U.S. Cl.
CPC ..... *F41C 33/002* (2013.01); *F41C 33/00* (2013.01)

(58) Field of Classification Search
CPC ..... F41C 33/002
USPC ..... 224/150; 42/85
See application file for complete search history.

(56) References Cited

U.S. PATENT DOCUMENTS 5,802,756 A * 9/1998 Hightower ..... F41C 33/002 42/85
D634,390 S * 3/2011 Shulman ..... D22/108
7,959,046 B2 * 6/2011 Burnsed, Jr. ..... F41C 33/001 224/150
8,430,285 B2 * 4/2013 Burnsed, Jr. ..... F41C 23/02 224/150
9,291,425 B2 * 3/2016 Golob ..... F41C 33/002
2006/0011677 A1 * 1/2006 Burnsed ..... F41C 33/001 224/150
2008/0217371 A1 * 9/2008 Wemmer ..... F41C 33/00 224/579
2011/0186603 A1 * 8/2011 Alford ..... F41C 33/00 224/150
2014/0203054 A1 * 7/2014 Dove ..... F41C 33/001 224/257
2015/0076181 A1 * 3/2015 Seuk ..... F41C 33/002 224/150
2015/0198411 A1 * 7/2015 Chudzik ..... F41C 33/002 224/150

FOREIGN PATENT DOCUMENTS

EP 2189748 B1 * 8/2015 ..... F41C 23/02

* cited by examiner

*Primary Examiner* — Justin Larson
(74) *Attorney, Agent, or Firm* — Shaddock Law Group, PC

(57) ABSTRACT

A sling having an elongate primary webbing portion and webbing extension portions, wherein each webbing extension portion has a width greater than the primary webbing portion, and wherein a webbing extension portion is attached or coupled proximate a first end and a second end of the primary webbing portion. A tubular webbing portion, wherein a portion of the primary webbing portion is slidable within the cavity of the tubular webbing portion. A ladder lock buckle attached or coupled proximate the second end of the primary webbing portion. An extended webbing portion attached or coupled to the primary webbing portion by interaction with the ladder lock buckle, wherein the extended webbing portion interacts with the ladder lock buckle such that the extended webbing portion can be shortened or extended. A webbing grip portion formed proximate the second end of the extended webbing portion.

20 Claims, 6 Drawing Sheets

SLING

CROSS-REFERENCE TO RELATED APPLICATIONS

This patent application claims the benefit of U.S. Patent Application Ser. No. 61/948,435, filed Mar. 5, 2014, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of slings. More specifically, the present invention relates to a sling adaptable to be used with a firearm.

2. Description of Related Art

It is generally known to attach a sling to various portions of a firearm, such as, for example, a rifle or carbine, to assist in maintaining the firearm in a particular location relative to a user's body and to allow the firearm to be attached to the user's body, even when the user is not holding the firearm with his or her hands.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical sling arrangement has various shortcomings.

In various exemplary, non-limiting embodiments, the sling of the present invention comprises an elongate primary webbing portion extending from a first end to a second end; a first webbing extension portion and a second webbing extension portion, each having a width that is greater than the primary webbing portion, wherein the first webbing extension portion is attached or coupled proximate the first end of the primary webbing portion and wherein the second webbing extension portion is attached or coupled proximate the second end of the primary webbing portion; a tubular webbing portion, wherein a portion of the primary webbing portion is fitted within a cavity of the tubular webbing portion, such that the primary webbing portion is slidable within the cavity of the tubular webbing portion; a first attachment device attached or coupled proximate the first end of the elongate primary webbing portion; a ladder lock buckle attached or coupled proximate the second end of the primary webbing portion; an extended webbing portion that extends from a first end to a second end, wherein the extended webbing portion is attached or coupled to the primary webbing portion by interaction with the ladder lock buckle, wherein the extended webbing portion interacts with the ladder lock buckle such that the extended webbing portion can be shortened, providing extended, partially retracted, and retracted positions for the extended webbing portion; a webbing grip portion formed proximate the second end of the extended webbing portion; and a second attachment device attached or coupled proximate the first end of the extended webbing portion.

Accordingly, the presently disclosed invention provides a sling that allows a user to readily adjust the overall length of the sling, within a determined parameter.

The presently disclosed invention separately provides a sling that allows a user to readily adjust the overall length of the sling, while the sling is being worn.

The presently disclosed invention separately provides a sling that reduced the pain/discomfort to a user's neck and/or shoulders when using the sling.

The presently disclosed invention separately provides a sling that can be easily manipulated by a user.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
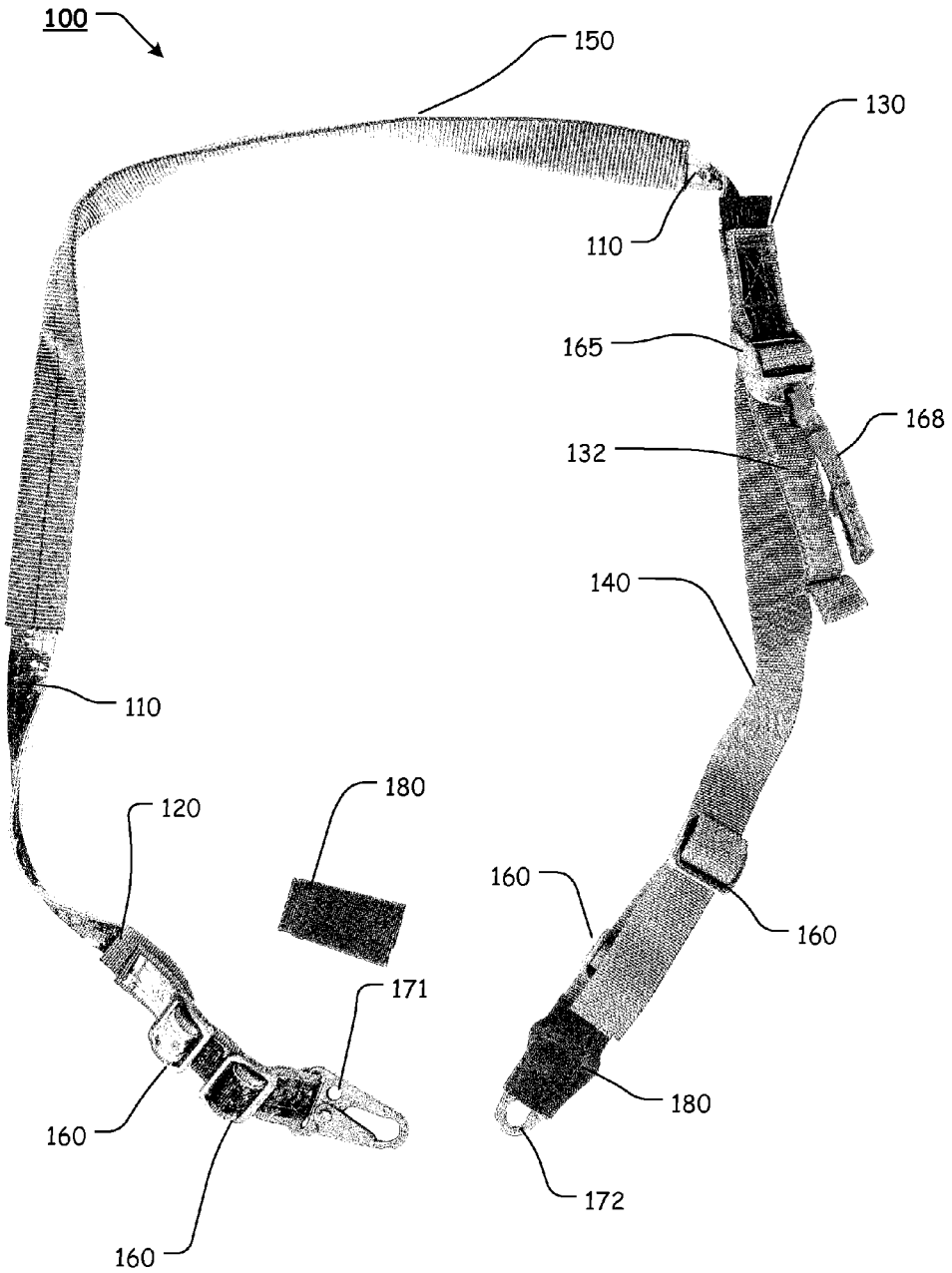
FIG. 1 illustrates a first exemplary embodiment of the sling, according to this invention.
Figure 2A:
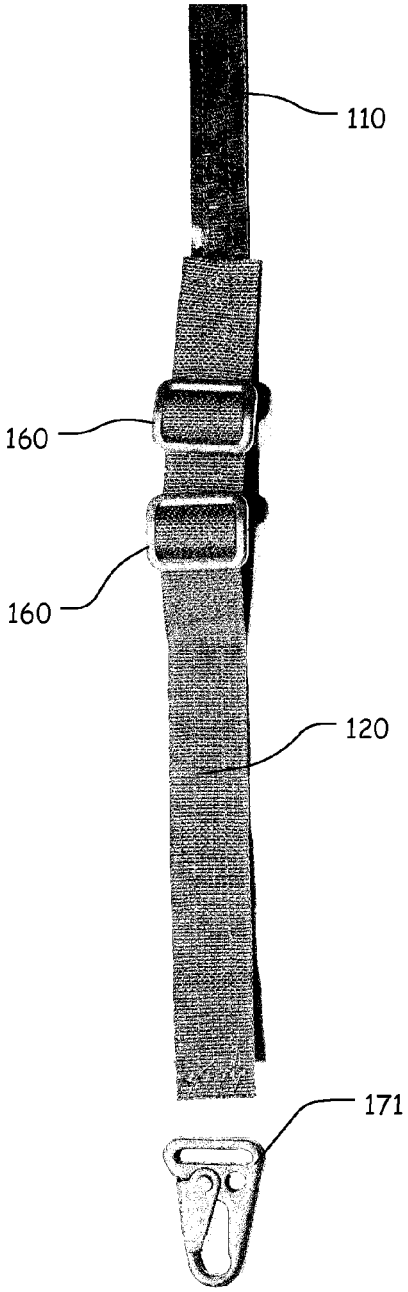
FIG. 2A illustrates a first more detailed view of the first end of the primary webbing portion of an exemplary embodiment of the sling, according to this invention.
Figure 2B:
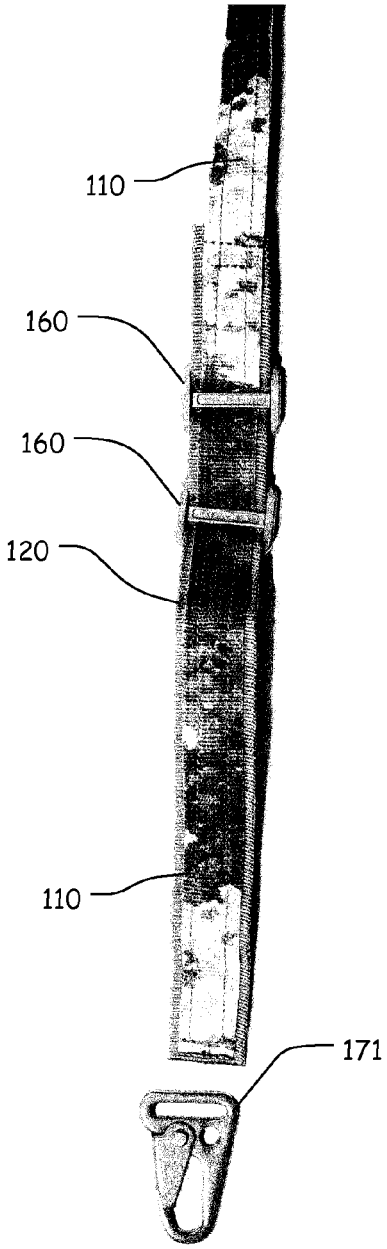
FIG. 2B illustrates a second more detailed view of the first end of the primary webbing portion of an exemplary embodiment of the sling, according to this invention.
Figure 3:
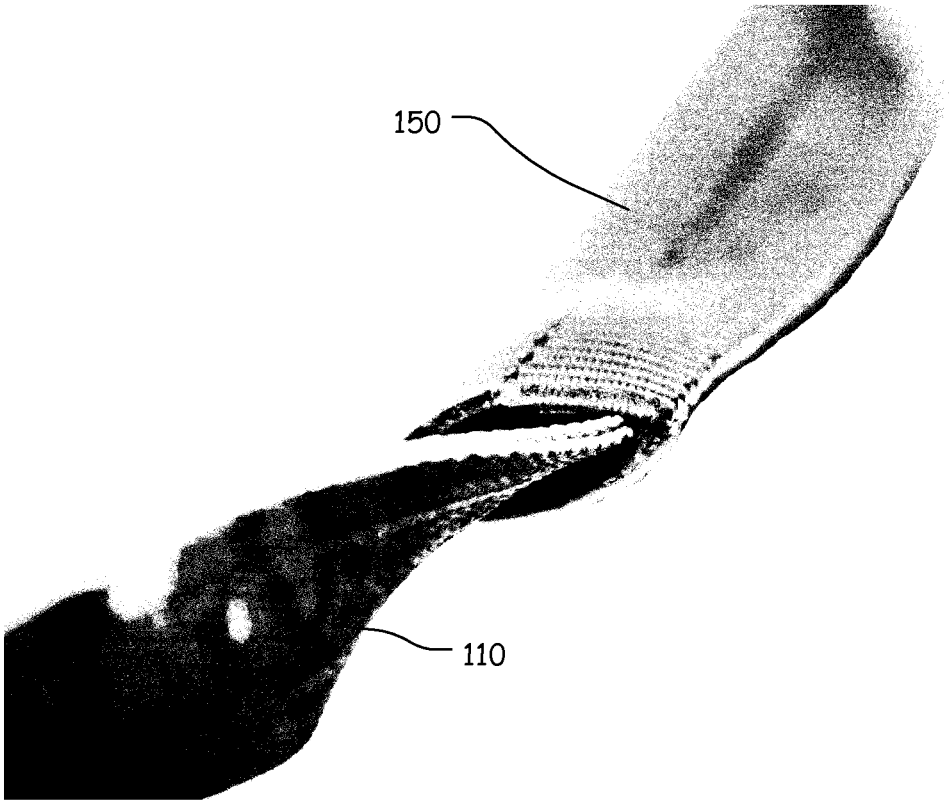
FIG. 3 illustrates a more detailed view of the interaction between the primary webbing portion and the tubular webbing portion of an exemplary embodiment of the sling, according to this invention.

For simplicity and clarification, the design factors and operating principles of the sling according to this invention are explained with reference to various exemplary embodiments of a sling according to this invention. The basic explanation of the design factors and operating principles of the sling is applicable for the understanding, design, and operation of the sling of this invention. It should be appreciated that the sling can be adapted to many applications where a sling or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "sling", "strap", "buckle", and "firearm" are used for basic explanation and understanding of the operation of the systems, methods, and apparatuses of this invention. Therefore, the terms "sling", "strap", "buckle", and "firearm" are not to be construed as limiting the systems, methods, and apparatuses of this invention. Thus, the terms "sling" and "strap" are to be understood to broadly include any elongate portion of material capable of him being attached or coupled to an object.

For simplicity and clarification, the sling of this invention will be described as being used in conjunction with a firearm, such as a rifle or carbine. However, it should be appreciated that these are merely exemplary embodiments of the sling and are not to be construed as limiting this invention. Thus, the sling of this invention may be utilized in conjunction with any object or device.

Turning now to the drawing Figs., FIGS. 1-6 illustrate certain elements and/or aspects of a first exemplary embodiment of the sling 100, according to this invention. In illustrative, non-limiting embodiment(s) of this invention, as illustrated in FIGS. 1-6, the sling 100 comprises an elongate primary webbing portion 110 extending from a first end to a second end. In various exemplary embodiments, the primary webbing portion 110 may optionally comprise a ¾ inch webbing material. Alternatively, the primary webbing portion 110 may optionally comprise a portion of webbing material with a width between ¼ inch and 1 inch.

A first webbing extension portion 120 is attached or coupled proximate the first end of the primary webbing portion 110 and a second webbing extension portion 130 is attached or coupled proximate the second end of the primary webbing portion 110. The first webbing extension portion 120 and the second webbing extension portion 130 each have a width that is greater than the primary webbing portion 110. In various exemplary environments, the first webbing extension portion 120 and the second webbing extension portion 130 may optionally comprise a 1 inch webbing material. Alternatively, the first webbing extension portion 120 and the second webbing extension portion 130 may optionally comprise a portion of webbing material with a width between ½ inch and 1½ inches.

While the sling 100 is shown and described as having a first webbing extension portion 120 and a second webbing extension portion 130 of similar widths, it should be appreciated that the width of the first webbing extension portion 120 may be the same or different from the width of the second webbing extension portion 130.

By providing a primary webbing portion 110 with a different width from the first webbing extension portion 120 and the second webbing extension portion 130, the primary webbing portion 110 can accommodate the tubular webbing portion 150, while allowing more standardized buckles and accessories to be used in areas of the first webbing extension portion 120 and the second webbing extension portion 130.

A portion of the primary webbing portion 110 is fitted within a cavity of a section of tubular webbing portion 150 or tubular tape, such that the tubular webbing portion 150 is able to slide back and forth along the exterior surface of the primary webbing portion 110. Likewise, the primary webbing portion 110 is able to slide back and forth within the cavity of the tubular webbing portion 150.

During use, the tubular webbing portion 150 is typically placed along a user's neck and shoulders. By allowing the tubular webbing portion 150 to slide relative to the primary wedding portion, the tubular webbing portion 150 can be maintained in a particular position, while the primary webbing portion 110 can slide within the tubular webbing portion 150. In this manner, the user's neck and shoulders are not affected by movement of the primary webbing portion 110, because the tubular webbing portion 150 can maintain a relatively stable position relative to the user's body.

A first sling hook 171, such as, for example, a HK style sling hook, a claw hook, a pushbutton quick disconnect sling swivel, a loop of cord or other material, a D ring, or other attachment device is attached or coupled proximate the first end of the elongate primary webbing portion 110. In various exemplary embodiments, the first sling hook 171 is attached or coupled proximate the first end of the primary webbing portion 110, within the first webbing extension portion 120, by inserting a portion of the first webbing extension portion 120 through an aperture in the first sling hook 171 and releasably attaching or coupling portions of the first webbing extension portion 120, via one or more tri-glide buckles 160, ladder lock buckle 165s, or similar devices.

An elastic webbing cover 180 may optionally be used to cover the first sling hook 171.

In various exemplary embodiments, a ladder lock buckle 165, such as, for example, a GT ruck buckle, is attached or coupled proximate the second end of the primary webbing portion 110, within the second webbing extension portion 130, by inserting a portion of the second webbing extension portion 130 through an aperture in the ladder lock buckle 165 and releasably or permanently attaching or coupling, such as, for example, by stitching, portions of the second webbing extension portion 130.

An optional tab 168 may be attached or coupled to the ladder lock buckle 165 to assist in the use and operation of the ladder lock buckle 165.

An extended webbing portion 140 extends from a first end to a second end and is attached or coupled to the primary webbing portion 110 (and the second webbing extension portion 130) by being interlaced in the ladder lock buckle 165.

A second sling hook 172, such as, for example, a HK style sling hook, a claw hook, a pushbutton quick disconnect sling swivel, a loop of cord or other material, a D ring, or other attachment device is attached or coupled proximate the first end of the extended webbing portion 140. In various exemplary embodiments, the second sling hook 172 is attached or coupled proximate the first end of the extended webbing portion 140 by inserting a portion of the extended webbing portion 140 through an aperture in the second sling hook 172 and releasably attaching or coupling portions of the extended webbing portions 140, via one or more tri-glide buckles 160, ladder lock buckle 165s, or similar devices.

An elastic webbing cover 180 may optionally be used to cover the second sling hook 172.

A webbing grip portion 132, or tail, is formed proximate the second end of the extended webbing portion 140. In various exemplary embodiments, the webbing grip portion 132 is formed by doubling over a portion of the extended webbing portion 140 and attaching or coupling portions of the extended webbing portion 140, such as, for example, by stitching. In certain exemplary embodiments, rigidity may be added to the webbing grip portion 132 by the inclusion of a portion of material secured between the doubled over portions of the extent webbing portion.

The webbing grip portion 132 is typically about 3 to 4 inches, allowing a user to secure a sufficient degree of purchase on the webbing grip portion 132.

Figure 4:
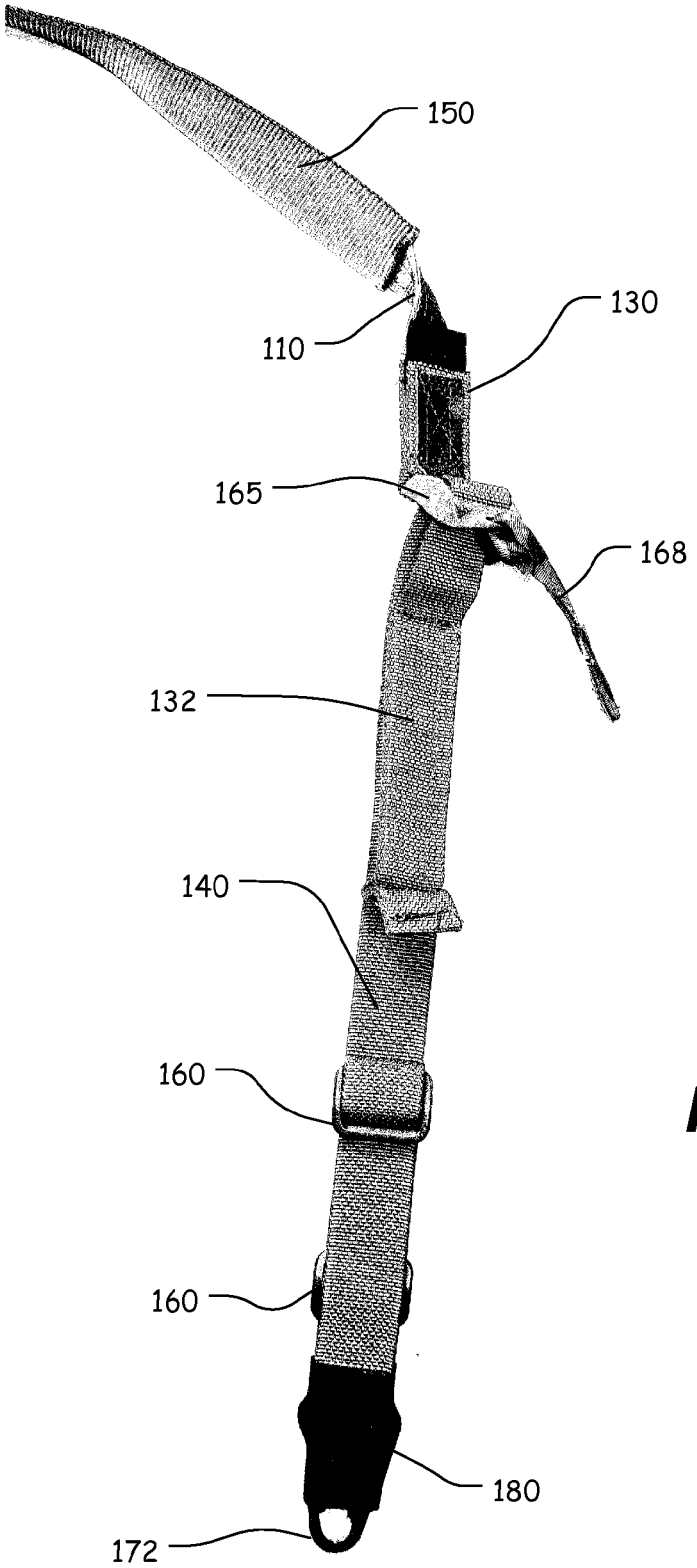
FIG. 4 illustrates a more detailed view of the second end of the primary webbing portion and the extended webbing portion of an exemplary embodiment of sling, wherein the extended webbing portion is in an extended position, according to this invention.
Figure 5:
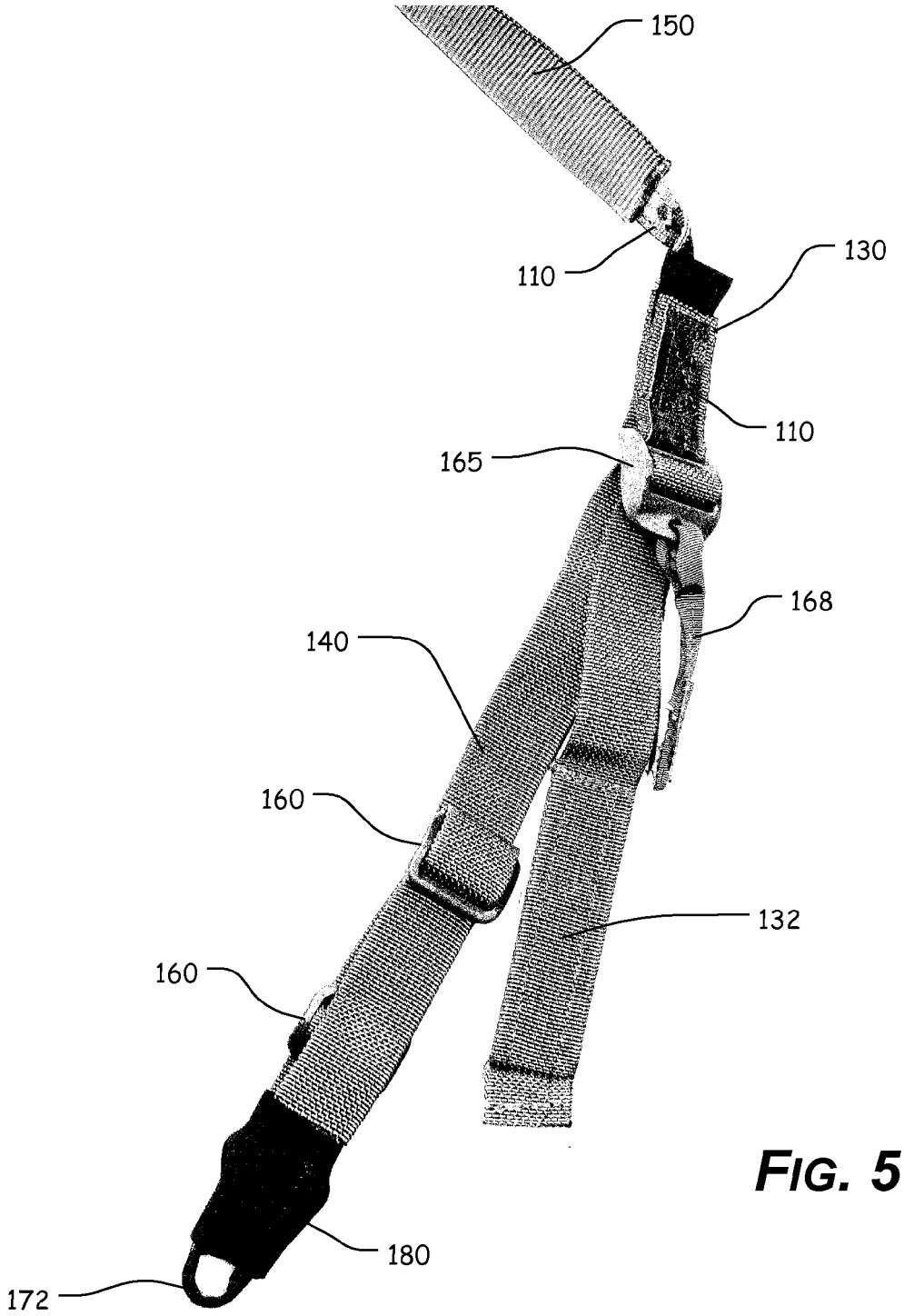
FIG. 5 illustrates a more detailed view of the second end of the primary webbing portion and the extended webbing portion of an exemplary embodiment of sling, wherein the extended webbing portion is in a partially retracted position, according to this invention.
Figure 6:
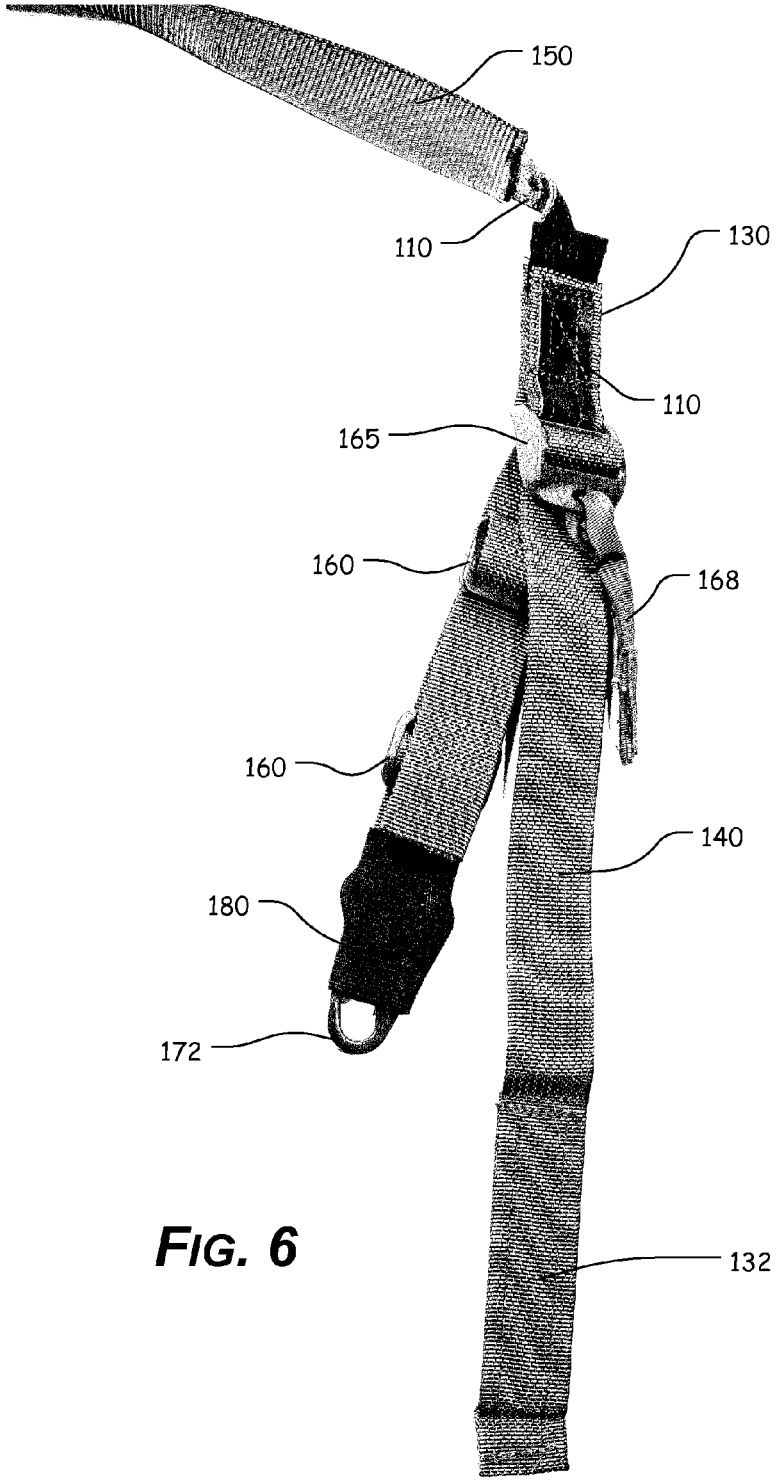
FIG. 6 illustrates a more detailed view of the second end of the primary webbing portion and the extended webbing portion of an exemplary embodiment of sling, wherein the extended webbing portion is in a retracted position, according to this invention.

The extended webbing portion 140 is interlaced within the ladder lock buckle 165 such that the extended webbing portion 140 can be shortened, providing extended, partially retracted, and retracted positions for the extended webbing portion 140, as illustrated in FIGS. 4-6.

FIG. 4 illustrates the extended webbing portion 140 is in an extended position. By pulling on the webbing grip portion 132, a portion of the extent webbing portion is urged through the ladder lock buckle 165, shortening the length of the extended webbing portion 140 and retracting the extended webbing portion 140. As illustrated in FIG. 5, the webbing grip portion 132 can be manipulated so that the extended webbing portion 140 is in a partially retracted position. Alternatively, as illustrated in FIG. 6, the webbing grip portion 132 can be manipulated so that the extended webbing portion 140 is in a fully retracted position.

It should be appreciated that the ladder lock buckle 165 can be manipulated (potentially by pulling the tab 168), to release the extent webbing portion, so that the extended webbing portion 140 can be manipulated from a fully retracted position to a fully extended position.

Manipulating the extent webbing portion between the extended and retracted positions can be useful when manipulating a firearm attached or coupled to the sling 100, via, for example, the first sling hook 171 and the second sling hook 172.

In various exemplary, non-limiting embodiments, all or portions of the primary webbing portion 110, the first webbing extension portion 120, the second webbing extension portion 130, and/or the extended webbing portion 140 may be made of any fabric or other material, such as, for example, woven fabrics, canvas, acrylics, sheet fabrics, films, nylon, spandex, vinyl, Polyvinyl Chloride (PVC), neoprene, or the like. Additionally, all or portions of the primary webbing portion 110, the first webbing extension portion 120, the second webbing extension portion 130, and/or the extended webbing portion 140 may be made of any flexible and/or elastic material and may stretch. Alternatively, all or portions of the primary webbing portion 110, the first webbing extension portion 120, the second webbing extension portion 130, and/or the extended webbing portion 140 may be formed from multiple, similar or dissimilar materials. In various exemplary, non-limiting embodiments, the primary webbing portion 110, the first webbing extension portion 120, the second webbing extension portion 130, and/or the extended webbing portion 140 may be water-resistant or may include a cushion material.

It should be appreciated that the terms fabric and material are to be given their broadest meanings and that the particular fabric(s) or material(s) used to form the primary webbing portion 110, the first webbing extension portion 120, the second webbing extension portion 130, and/or the extended webbing portion 140 is a design choice based on the desired appearance and/or functionality of the sling 100.

It should also be appreciated that a more detailed explanation of the considerations for selecting the specific types and sizes of webbing material, buckles, and/or attachment devices used for the sling 100, instructions regarding how to install the sling 100, methods for using the sling 100, once installed, and certain other items and/or techniques necessary for the implementation and/or operation of the various exemplary embodiments of the present invention are not provided herein because such elements are commercially available and/or such background information will be known to one of ordinary skill in the art. Therefore, it is believed that the level of description provided herein is sufficient to enable one of ordinary skill in the art to understand and practice the invention, as described.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A sling, comprising:

an elongate primary webbing portion extending from a first end to a second end;

a first webbing extension portion, wherein a width of said first webbing extension portion is greater than a width of said primary webbing portion, wherein said first webbing extension portion is attached or coupled proximate said first end of said primary webbing portion;

a second webbing extension portion, wherein a width of said second webbing extension portion is greater than said width of said primary webbing portion, wherein said second webbing extension portion is attached or coupled proximate said second end of said primary webbing portion;

a tubular webbing portion, wherein a portion of said primary webbing portion is fitted within a cavity of said tubular webbing portion, such that said primary webbing portion is slidable within said cavity of said tubular webbing portion;

a first attachment device attached or coupled proximate said first end of said elongate primary webbing portion;

a ladder lock buckle attached or coupled proximate said second end of said primary webbing portion;

an extended webbing portion that extends from a first end to a second end, wherein said extended webbing portion is attached or coupled to said primary webbing portion by interaction with said ladder lock buckle, wherein said extended webbing portion interacts with said ladder lock buckle such that said extended webbing portion can be shortened, providing extended, partially retracted, and retracted positions for said extended webbing portion;

a webbing grip portion formed proximate said second end of said extended webbing portion; and a second attachment device attached or coupled proximate said first end of said extended webbing portion.

2. The sling of claim 1, wherein said width of said primary webbing portion is approximately ¾ inch.

3. The sling of claim 1, wherein said width of said primary webbing portion is approximately ¼ inch to 1¼ inch.

4. The sling of claim 1, wherein said width of said first webbing extension portion is approximately 1 inch.

5. The sling of claim 1, wherein said width of said first webbing extension portion is approximately ½ inch to 1½ inches.

6. The sling of claim 1, wherein said width of said second webbing extension portion is approximately 1 inch.

7. The sling of claim 1, wherein said width of said second webbing extension portion is approximately ½ inch to 1½ inches.

8. The sling of claim 1, wherein said width of said first webbing extension portion is equal to said width of said second webbing extension portion.

9. The sling of claim 1, wherein said width of said first webbing extension portion is greater than said width of said second webbing extension portion.

10. The sling of claim 1, wherein said width of said first webbing extension portion is less than said width of said second webbing extension portion.

11. The sling of claim 1, wherein a tab is attached or coupled to said ladder lock buckle to assist in said use and operation of said ladder lock buckle.

12. The sling of claim 1, wherein an elastic webbing cover covers said sling hook.

13. The sling of claim 1, wherein said webbing grip portion is approximately 3 inches to 4 inches.

14. A sling, comprising:

an elongate primary webbing portion extending from a first end to a second end;

a first webbing extension portion, wherein a width of said first webbing extension portion is greater than a width of said primary webbing portion, wherein said first webbing extension portion is attached or coupled proximate said first end of said primary webbing portion;

a second webbing extension portion, wherein a width of said second webbing extension portion is greater than said width of said primary webbing portion, wherein said second webbing extension portion is attached or coupled proximate said second end of said primary webbing portion;

a tubular webbing portion, wherein a portion of said primary webbing portion is fitted within a cavity of said tubular webbing portion, such that said primary webbing portion is slidable within said cavity of said tubular webbing portion;

a first attachment device attached or coupled proximate said first end of said elongate primary webbing portion; and a second attachment device attached or coupled proximate said first end of said extended webbing portion.

15. The sling of claim 14, wherein said width of said primary webbing portion is approximately ¼ inch to 1¼ inch.

16. The sling of claim 14, wherein said width of said first webbing extension portion is approximately ½ inch to 1½ inches.

17. The sling of claim 14, wherein said width of said second webbing extension portion is approximately ½ inch to 1½ inches.

18. The sling of claim 14, wherein said width of said first webbing extension portion is equal to, greater than, or less than said width of said second webbing extension portion.

19. A sling, comprising:

an elongate primary webbing portion extending from a first end to a second end;

a first webbing extension portion, wherein a width of said first webbing extension portion is greater than a width of said primary webbing portion, wherein said first webbing extension portion is attached or coupled proximate said first end of said primary webbing portion;

a second webbing extension portion, wherein a width of said second webbing extension portion is greater than said width of said primary webbing portion, wherein said second webbing extension portion is attached or coupled proximate said second end of said primary webbing portion;

a tubular webbing portion, wherein a portion of said primary webbing portion is fitted within a cavity of said tubular webbing portion, such that said primary webbing portion is slidable within said cavity of said tubular webbing portion;

a first attachment device attached or coupled proximate said first end of said elongate primary webbing portion;

an extended webbing portion that extends from a first end to a second end, wherein said extended webbing portion is attached or coupled to said primary webbing portion by interaction with said ladder lock buckle, wherein said extended webbing portion interacts with a ladder lock buckle such that said extended webbing portion can be shortened, providing extended, partially retracted, and retracted positions for said extended webbing portion;

a webbing grip portion formed proximate said second end of said extended webbing portion; and a second attachment device attached or coupled proximate said first end of said extended webbing portion.

20. The sling of claim 19, wherein said width of said first webbing extension portion is equal to, greater than, or less than said width of said second webbing extension portion.

* * * * *